US012129856B2

(12) United States Patent
Radzikh

(10) Patent No.: US 12,129,856 B2
(45) Date of Patent: Oct. 29, 2024

(54) ROTOR HAVING A PLURALITY OF SPIRAL PATHWAYS TO PASS LIQUID OR GAS THERETHROUGH TO INCREASE POWER THEREOF

(71) Applicant: Yuriy Radzikh, Jenkintown, PA (US)

(72) Inventor: Yuriy Radzikh, Jenkintown, PA (US)

( * ) Notice: Subject to any disclaimer, the term of this patent is extended or adjusted under 35 U.S.C. 154(b) by 0 days.

(21) Appl. No.: 17/715,916

(22) Filed: Apr. 7, 2022

(65) Prior Publication Data

US 2022/0325627 A1 Oct. 13, 2022

Related U.S. Application Data

(60) Provisional application No. 63/173,013, filed on Apr. 9, 2021.

(51) Int. Cl.

| | |
|---|---|
| ***F04D 1/12*** | (2006.01) |
| ***F04D 29/22*** | (2006.01) |
| ***F04D 29/28*** | (2006.01) |

(52) U.S. Cl.

CPC ..... *F04D 1/12* (2013.01); *F04D 29/2255* (2013.01); *F04D 29/288* (2013.01)

(58) Field of Classification Search

CPC .... F04D 29/288; F04D 29/2255; F01D 1/003; F01D 1/12

See application file for complete search history.

(56) References Cited

U.S. PATENT DOCUMENTS 1,992,748 A * 2/1935 Groh ..... F04D 1/12 416/171
2,974,602 A * 3/1961 Lock ..... F04D 1/12 494/79
3,926,534 A * 12/1975 Erickson ..... F04D 1/12 415/80

FOREIGN PATENT DOCUMENTS

JP 57140596 A * 8/1982 ..... F04D 29/2255

* cited by examiner

*Primary Examiner* — Courtney D Heinle
*Assistant Examiner* — John S Hunter, Jr.
(74) *Attorney, Agent, or Firm* — Ryder, Mazzeo & Konieczny LLC; Douglas J. Ryder

(57) ABSTRACT

A rotor having spiral pathways to enable liquid or gas to flow from a center to an exterior thereof. The spiral pathways increases power generated (input force) as liquid/gas travels therethrough. The spiral pathway rotor includes an inner disk and an outer disk. Inner disk includes a central opening for receiving the liquid/gas and is connected to a plurality of pathways that extend toward an outer edge in a spiral manner. Nozzles may be utilized to expel the liquid/gas. Outer disk includes an open interior having a plurality of teeth formed on an interior surface. The teeth are configured to receive the liquid/gas expelled from inner disk which causes the rotor to rotate and thus increases the input force thereof. The input force is amplified to an output force on a shaft connected thereto.

17 Claims, 4 Drawing Sheets

ROTOR HAVING A PLURALITY OF SPIRAL PATHWAYS TO PASS LIQUID OR GAS THERETHROUGH TO INCREASE POWER THEREOF

BACKGROUND

Levers can be utilized to amplify an input force to provide a greater output force. A lever is a simple machine that includes a rod pivoted about a fixed point (fulcrum). The law of the lever defines that the input force times a distance the input force is from the fulcrum (input lever arm) equals the output force times a distance the output force is from the fulcrum (output lever arm). Accordingly, if the input lever arm is longer than the output lever arm (input force is applied further away from fulcrum than output force is generated), the output force will be greater than the input force (the force will be amplified).

Wheels and axels are a variation of a lever that can be also be utilized to amplify an input force to provide a greater output force. In this case, a fulcrum is a center point of the wheel and the axel. A distance from the fulcrum to a circumference of the wheel (wheel radius) is an input lever arm and a distance from the fulcrum to a circumference of the axel (axel radius) is an output lever arm. FIG. 1 illustrates a simple example of a wheel and axel being utilized to amplify the output force. A wheel 100 and an axel 150 are connected to each other so as to share a central point (fulcrum) 140. The wheel 100 has a radius (input lever arm) 110 and requires a force 120 to rotate the wheel 100. The axel 150 has a radius (output lever arm) 160 and generates a force 170 when the axel 150 is rotated. As the input lever arm 110 is longer than the output lever arm 160 (wheel radius 110 is larger than axel radius 160), the output force 170 is greater than the input force 120 (the force will be amplified). By way of example, if the radius of wheel is three times (3×) greater than the radius of the axel, the force generated by the axel will be three times (3×) greater than the force consumed by the wheel.

The amplification of the force created by the wheel and axel may be utilized for various purposes. For example, the output force 170 may be utilized to move objects or may be utilized to create energy (e.g., generator). The force may be measured as torque or power. Regardless of what the wheel and axel are being used for it is desirable to make it easier to apply the input force and/or to require less energy (power) to apply the force. Furthermore, it may be desirable to increase the input force and accordingly either increase the output force or reduce the size difference between the input lever and output lever. Additionally, it is desirable to make it easier to utilize the output force and to get the most benefit therefrom.

Windmills and waterwheels use water or wind to rotate blades, buckets or the like that form the wheels which in turn rotate the axels. The rotation of the axel is utilized to generate power. The water utilized by a waterwheel may be naturally flowing in a river or the like and thus not require power consumption. Likewise, the air utilized by a windmill may be naturally provided by the atmosphere and thus not require power consumption. Accordingly, the increase in force and the associated power created therefrom is a net gain. However, the use of these natural elements is subject to the strength and/or availability of wind and/or water. Accordingly, these wheel and axels may not be capable of working when required or providing a consistent power source. To ensure they run continuously a backup power source may be required.

The use of the wheel and axel to generate power is not limited to windmills and waterwheels using naturally available resources (e.g., wind, water). Rather, the water (or other fluid) and/or air could be pumped so as to turn the wheel (e.g., blades, buckets). The use of a pump requires power to get appropriate pressure and volume to get generate desired force and speed for the wheel. The wheel could be turned using, for example, motor(s), magnets and coils, and/or electromagnetic coils. The desired force and speed may be generated by setting frequency and strength of the electrical pulse, according to the strength of magnets and electric coils.

What is needed is a manner in which to reduce the power required to generate the desired force of the wheel and also to provide a durable and reliable operation.

BRIEF DESCRIPTION OF THE DRAWINGS

The features and advantages of the various embodiments will become apparent from the following detailed description in which.

DETAILED DESCRIPTION

Figure 1:
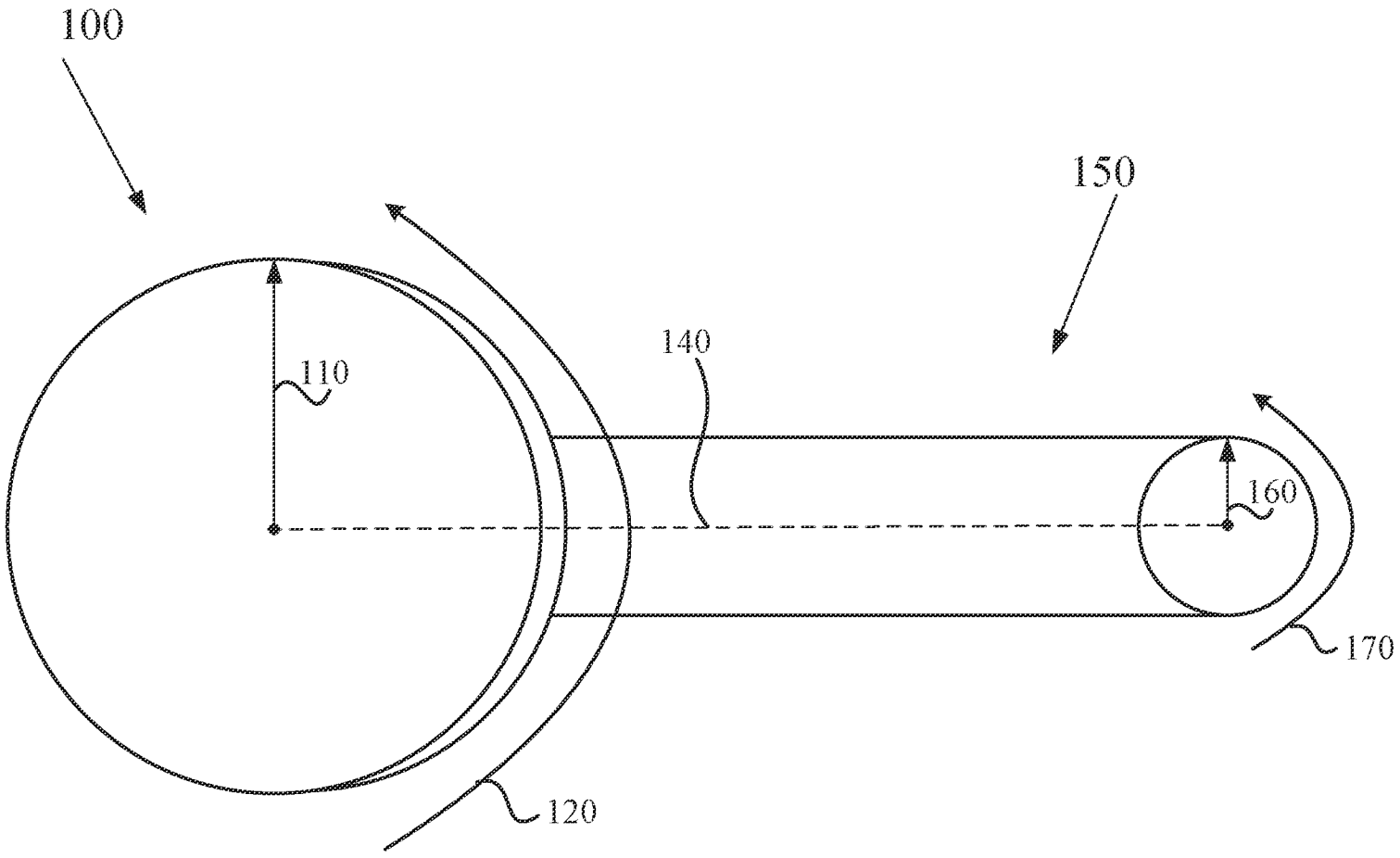
FIG. 1 (Prior Art)
FIG. 1 illustrates a simple example of a wheel and axel showing the increased power in the shaft (amplification of wheel force).
Figure 2:
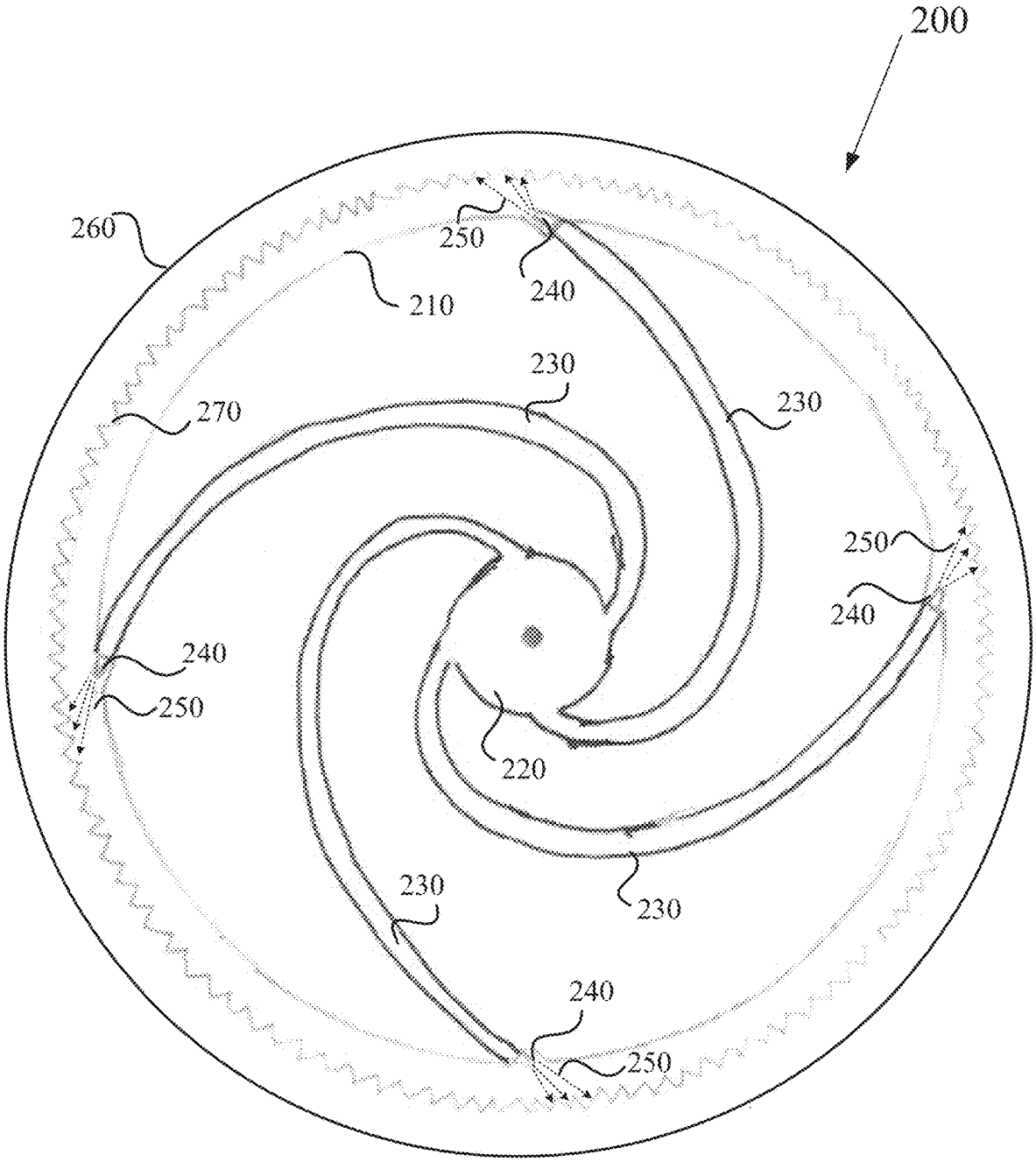
FIG. 2 illustrates an example wheel (rotor) that utilizes spiral pathways to enable liquid or gas to flow from a center to an exterior thereof to rotate the rotor at a desired speed and create an input force, according to one embodiment.

FIG. 2 illustrates an example wheel (rotor) 200 that utilizes spiral pathways to enable liquid or gas to flow from a center to an exterior thereof to rotate the rotor 200 at a desired speed and create an input force. The spiral pathway rotor 200 may increase the power generated thereby (input force) as the liquid or gas travels from the center to the exterior thereof. The input force associated with rotating the rotor 200 is amplified to an output force for the rotation of an associated axel (not illustrated) based on the differences in the radius of the rotor and the axel. The spiral pathway rotor 200 may reduce the energy required to pump the necessary liquid/gas in order to turn at the desired speed. The spiral pathway rotor 200 includes an inner disk 210 and an outer disk 260. The inner disk 210 includes a central receptacle 220 for receiving the liquid or gas. The liquid may be water, oil or various other liquids. The gas may be compressed air or other gases.

The central receptacle 220 includes a plurality of openings (4 illustrated) that connect to a plurality of pipes 230 (4 illustrated) that extend therefrom toward an outer edge of the inner disk 210 in a spiral manner. The outer edge of the inner disk 210 includes openings (not identified) that the pipes 230 connect to. Nozzles 240 are located at the end of the pipes 230 in the openings in the outer edge. The liquid/gas is received at the opening 220 and then passes through the pipes 230 and is expelled out the nozzles 240 as a pressurized jet of liquid/gas 250. It should be noted that the number of pipes 230 is not limited to any specific number. Furthermore, the pipes 230 are not intended to be limited to any size and the exact configuration of the spiral is not limited to any specific angle. Rather, these parameters may change based on the specific use without departing from the current scope.

The outer disk 260 includes an open interior where an interior surface thereof is a gear having a plurality of teeth (blades) 270. The teeth 270 are configured to receive the jet 250 that exits the nozzles 240 so that the jet 250 additionally causes the rotor 200 to rotate and increases the input force. The number, shape and size of the teeth 270 is not intended to be limited in any manner. The teeth 270 may be configured such that one tooth 270 receives the entire jet 250 or so that a plurality of teeth 270 receive the jet 250. As illustrated, a plurality of teeth 270 are receiving the jet 250 from each nozzle 240. The distance the teeth 270 are from the nozzles 240 may be calculated such that the most efficient use of the jet 250 is obtained. This may be the point where the pressure from the jet 250 is the strongest.

It should be noted that as illustrated the teeth 270 are included on the entire inner surface of the outer disk 260. The outer disk 260 may be modified so as to only include teeth 270 in alignment with the nozzles 240 and where the associated jets 250 may be applied without departing from the current scope.

Figure 3:
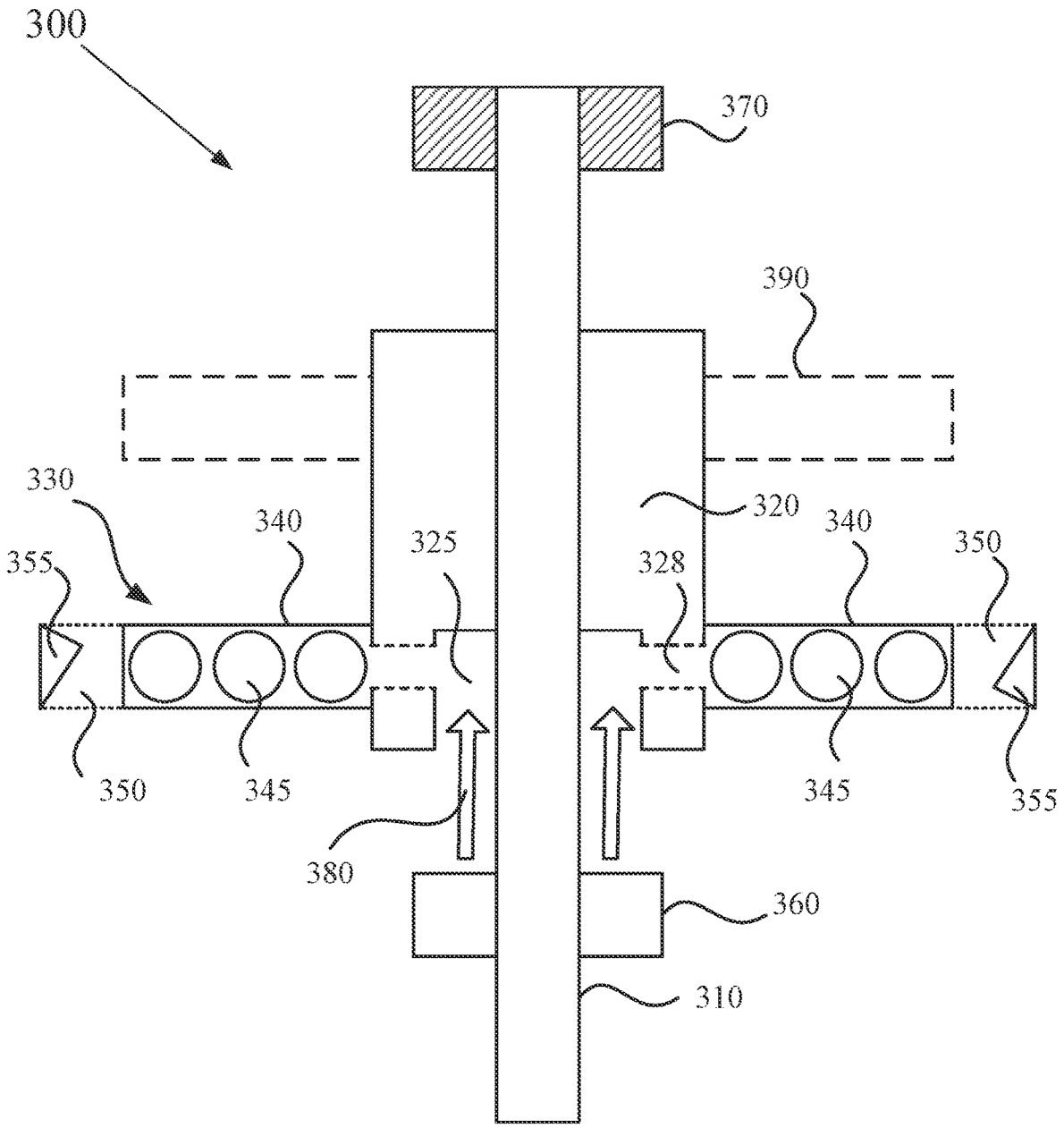
FIG. 3 illustrates a cross sectional view of an example system utilizing a spiral pathway rotor, according to one embodiment.

FIG. 3 illustrates a cross sectional view of an example system 300 utilizing a spiral pathway rotor (such as 200 from FIG. 2). The system includes a shaft 310, a hub 320, and a spiral pathway rotor 330. The system may include a pump 360 to pump the liquid/gas 380 to the spiral pathway rotor 330. It should be noted that the pump 360 may not be required if system is utilized where water and/or air freely flow. The system 300 may also include a housing (not illustrated) to secure the various components and to provide a pathway for the liquid/gas to get to the spiral pathway rotor 330. The hub 320 may be secured to the shaft 310 and the spiral pathway rotor 330 may be secured to the hub 320. The hub 320 may extend off the shaft 310 around the rotor 330 to provide a channel 325 for the liquid/gas 380 to flow and the channel 325 may include openings 328 to enable the liquid/gas to flow into the rotor 330.

The rotors 330 may include an inner disk 340 and an outer disk 350. The inner disk 340 may include a plurality of pathways 345 from the center thereof to openings in an exterior thereof. The liquid/gas may flow into the pathways 345 via the openings 328 and travel through the pathways 345 to the exterior thereof. The openings 328 in the exterior may include nozzles (not illustrated) to eject the liquid/gas therefrom. The pathways 345 are simply illustrated as a plurality of circles (tubes) in the cross-sectional view. Each of the circles may be a separate pathway 345 or several circles may make up a single pathway 345. As illustrated in FIG. 2 each of the pathways (pipes 230) only wrap around a portion (approximately 25-33%) of the rotor 200. According to alternative embodiments, each pathway may potentially wrap around a larger portion of the rotor, the whole rotor or wrap around the rotor more than once.

The outer disk 350 includes an open interior to enable the inner disk 340 to fit therewithin. The interior surface of the outer disk is a gear having a plurality of teeth (blades) formed therein 355 (a single blade is illustrated on each side). The liquid/gas expelled from the inner disk 340 will engage with the teeth 355 and further cause the rotor 330 to rotate.

The rotation of the rotor 330 causes the hub 320 to rotate and the hub 320 causes the shaft 310 to rotate. The law of levers provides that the force on the shaft 310 is greater than the force on the exterior of the rotor 330. As previously discussed the increase in force is based on the difference in the radius of the shaft 310 and the radius of the rotor 330. To utilize the force of the shaft 310 a gear 370 may be located on the shaft 310.

It should be noted that once the rotor 330 is fully operational a vacuum may be created within the system (pathway from pump 360 to rotor 330, and pathways 345 within rotor 330) and that at that point the power required to operate the pump 360 could be reduced. According to one embodiment, the system 300 may include a kinetic disk 390 mounted to the hub 320. The kinetic disk 390 rotates with the hub 320 and increase the force (power) of the shaft 310 by rotating its mass on the shaft 310.

Figure 4:
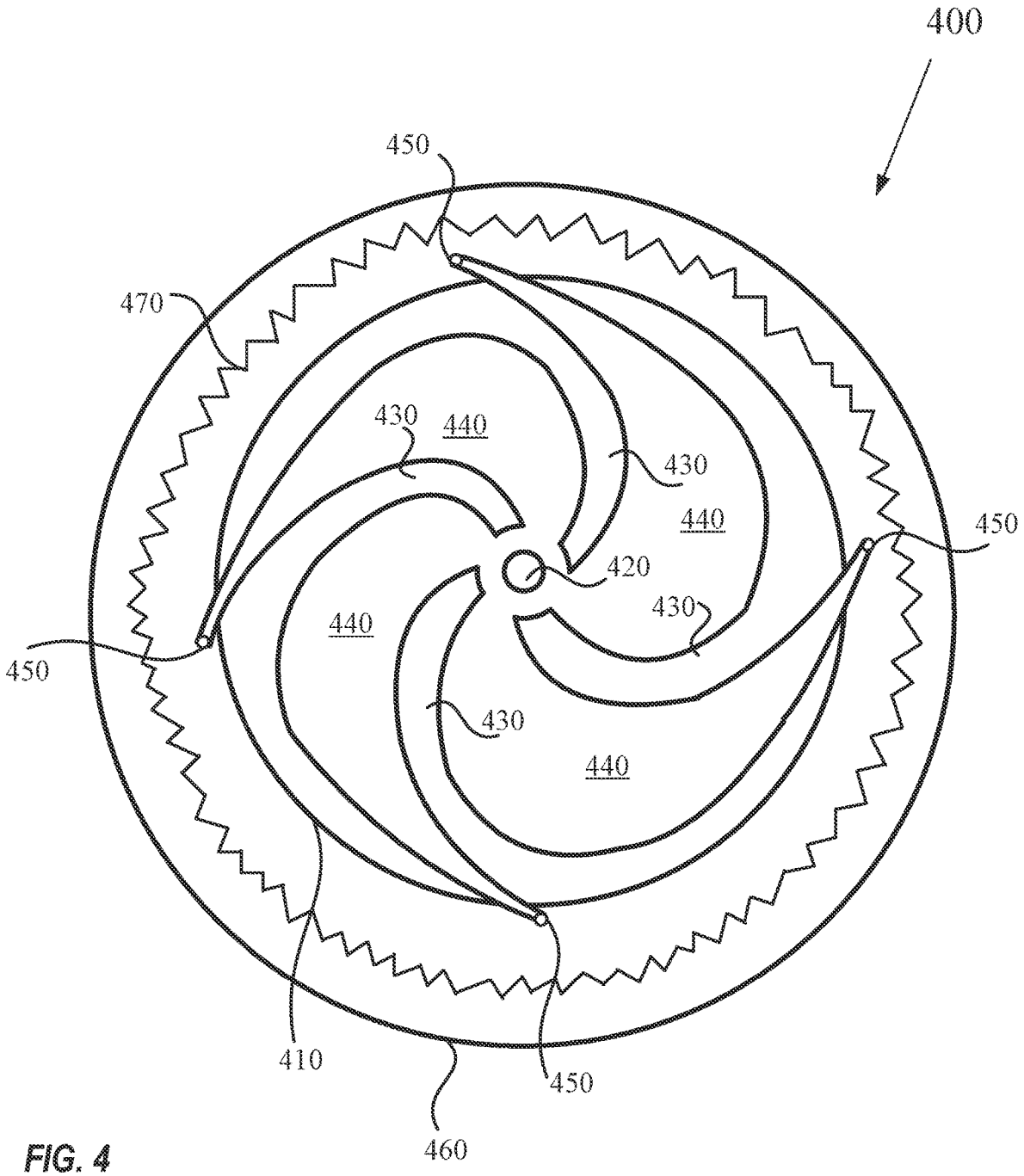
FIG. 4 illustrates an example alternative spiral pathway rotor, according to one embodiment.

FIG. 4 illustrates an example alternative spiral pathway rotor 400. The rotor 400 is similar to the rotor 200 in that it includes an inner disk 410 and an outer disk 460. The outer disk 460 may be similar to the outer disk 260 in that it includes an inner gear surface having a plurality of teeth 470. The inner disk 410 may include a central receptacle 420 for receiving the liquid/gas that is provided (e.g., pumped) thereto. A plurality of walls 430 (4 illustrated) extend from the central portion 420 toward an outer edge in a spiral manner. The walls 430 divide the inner rotor 410 into a plurality of hollow spiral sections 440 (4 illustrated). The outer edge of the inner disk 410 includes openings (not identified) in alignment with narrow portions (not identified) of the hollow spiral sections 440. Nozzles 450 are located at the end of the narrow portions 440 in the openings in the outer edge.

The liquid/gas is received at the central receptacle 420 and then passes through the hollow spiral sections 440 and is repulsed out of the nozzles 450 as a pressurized jet of liquid/gas. It should be noted that the number of walls 430 and sections 440 is not limited to any specific number. Furthermore, the sections 440 are not intended to be limited to any size or shape and the exact configuration of the spiral of the walls 430 and sections 440 is not limited to any specific angle. Rather, these parameters may change based on the specific use without departing from the current scope.

The invention has been disclosed as utilizing a pump to provide the liquid/gas to operate the spiral pathway rotors (e.g., 200, 330, 400). However, the rotors could be operated without a pump if the liquid/gas could be received at a center point thereof without needing the assistance thereof. For example, if the rotors were located where a consistent flow of liquid (e.g., water) was available to be provided to a center portion thereof. The liquid could be traverse the pathways to the outer edge and out the jets so as to engage the teeth and provide necessary rotation.

The spiral pathway rotors could be utilized in various systems as one skilled in the art would recognize.

Although the disclosure has been illustrated by reference to specific embodiments, it will be apparent that the disclosure is not limited thereto as various changes and modifications may be made thereto without departing from the scope. The various embodiments are intended to be protected broadly within the spirit and scope of the appended claims.

The invention claimed is:

1. A rotor comprising:

an inner disk having a centrally located receptacle, an outer edge and a plurality of spiral pathways traversing within the inner disk from the centrally located receptacle to the outer edge, wherein the receptacle, the outer edge and the plurality of spiral pathways are coplanar, wherein the centrally located receptacle includes an outer surface, wherein the outer edge has a first diameter and the centrally located receptacle outer surface has a second diameter that is substantially smaller than the first diameter, wherein the centrally located receptacle outer surface includes a corresponding plurality of receptacle openings, wherein the outer edge includes a corresponding plurality of edge openings, wherein each of the plurality of spiral pathways are connected to a receptacle and an edge opening, wherein the centrally located receptacle is configured to receive a liquid or a gas and provide the liquid or the gas to the plurality of spiral pathways via the plurality of receptacle openings, wherein the plurality of spiral pathways are configured to pass the liquid or the gas therethrough and provide the liquid or the gas to the plurality of edge openings, and wherein the liquid or the gas traversing the plurality of spiral pathways cause the rotor to rotate;

an outer disk having an open interior that provides an inner edge, wherein the inner edge includes a plurality of teeth formed therein, wherein the inner disk is located within the open interior of the outer disk so that the plurality of edge openings face the plurality of teeth; and a plurality of nozzles located in the plurality of edge openings, wherein the plurality of nozzles are configured to expel the liquid or the gas that traversed the plurality of spiral pathways as a jet of pressurized liquid or gas in a direction to contact a subset of the plurality of teeth and further cause the rotor to rotate.

2. The rotor of claim 1, wherein the plurality of nozzles are angled.

3. The rotor of claim 1, wherein the plurality of spiral pathways are a plurality of tubes.

4. The rotor of claim 1, wherein the plurality of spiral pathways are a plurality of hollow sections, wherein each hollow section has a varying width as it traverses from a receptacle to an edge opening and includes an expanded central portion and a narrow end portion connecting to the edge opening.

5. The rotor of claim 1, wherein the centrally located receptacle is configured to receive the liquid or the gas via a pump.

6. The rotor of claim 1, wherein the centrally located receptacle is configured to receive a continuous flow of the liquid or the gas.

7. A rotor comprising:

an outer disk having an open interior providing an inner edge having a plurality of teeth formed therein;

an inner disk located within the open interior of the outer disk, wherein the inner disk includes a receptacle centrally located, an outer edge, and a plurality of spiral pathways traversing within the inner disk from the receptacle to the outer edge, wherein the receptacle, the outer edge and the plurality of spiral pathways are coplanar, wherein the receptacle includes an outer surface, wherein the outer edge has a first diameter and the outer surface of the receptacle has a second diameter that is substantially smaller than the first diameter, wherein the outer surface of the receptacle includes a corresponding plurality of receptacle openings and the outer edge includes a corresponding plurality of edge openings, and wherein each of the plurality of spiral pathways includes a first side connecting to a corresponding one of the plurality of receptacle openings and a second side connecting to a corresponding one of the plurality of edge openings; and a plurality of nozzles located in the plurality of edge openings, wherein the receptacle is configured to receive a liquid or a gas and provide the liquid or the gas to the plurality of spiral pathways via the plurality of receptacle openings, the plurality of spiral pathways are configured to pass the liquid or the gas therethrough and provide the liquid or the gas to the plurality of nozzles, the plurality of nozzles are configured to expel the liquid or the gas as a jet of pressurized liquid or gas in a direction to contact a subset of the plurality of teeth, and the liquid or the gas traversing the plurality of spiral pathways and the jet of pressurized liquid or gas contacting the subset of the plurality of teeth cause the rotor to rotate.

8. The rotor of claim 7, wherein the plurality of spiral pathways are a plurality of tubes.

9. The rotor of claim 7, wherein the plurality of spiral pathways are a plurality of hollow sections, wherein each hollow section has a varying width as it traverses from a receptacle to an edge opening and includes an expanded central portion and a narrow end portion connecting to the edge opening.

10. The rotor of claim 7, wherein the receptacle is configured to receive the liquid or the gas via a pump.

11. The rotor of claim 7, wherein the receptacle is configured to receive a continuous flow of the liquid or the gas.

12. A system comprising a shaft;

a hub mounted to the shaft, wherein the hub includes a pathway to enable a liquid or a gas to flow therethrough; and a rotor mounted to the hub, wherein the rotor includes:

an outer disk having an open interior and an inner edge having a plurality of teeth formed therein;

an inner disk located within the open interior of the outer disk, wherein the inner disk includes a receptacle centrally located, an outer edge, and a plurality of spiral pathways traversing within the inner disk from the receptacle to the outer edge, wherein the receptacle, the outer edge and the plurality of spiral pathways are coplanar, wherein the receptacle includes an outer surface, wherein the outer edge has a first diameter and the outer surface of the receptacle has a second diameter that is substantially smaller than the first diameter, wherein the outer surface of the receptacle includes a plurality of receptacle openings and the outer edge includes a corresponding plurality of edge openings, and wherein the plurality of spiral pathways connect corresponding ones of the plurality of receptacle openings to the corresponding ones of the plurality of edge openings; and a plurality of nozzles located in the plurality of edge openings;

wherein the liquid or the gas traverses the pathway to the receptacle, enters the plurality of spiral pathways via the plurality of receptacle openings, traverses the plurality of spiral pathways and is expelled from the plurality of nozzles as a jet of pressurized liquid or gas in a direction to contact a subset of the plurality of teeth, and wherein the liquid or the gas traversing the plurality of spiral pathways and the jet of pressurized liquid or gas contacting the subset of the plurality of teeth cause the rotor to rotate, and wherein rotation of the rotor causes rotation of the shaft.

13. The system of claim 12, further comprising a pump to pump the liquid or the gas through the pathway in the hub to the receptacle.

14. The system of claim 12, further comprising a gear mounted to the shaft to rotate with the shaft and transfer a force associated with the rotation of the shaft to another device.

15. The system of claim 12, further comprising a kinetic disk mounted to the shaft to rotate with the shaft and increase a force associated with the rotation of the shaft.

16. The system of claim 12, wherein the plurality of spiral pathways are a plurality of tubes.

17. The system of claim 12, wherein the plurality of spiral pathways are a plurality of hollow sections, wherein each hollow section has a varying width as it traverses from a receptacle to an edge opening and includes an expanded central portion and a narrow end portion connecting to the edge opening.

* * * * *